US005363619A

United States Patent [19]

McPhee

[11] Patent Number: 5,363,619

[45] Date of Patent: Nov. 15, 1994

[54] POSITIVE LOCKING CONCRETE SCREED RAIL

[75] Inventor: Mike McPhee, Charlotte, N.C.

[73] Assignee: Permaban North America, Inc., Matthews, N.C.

[21] Appl. No.: 984,982

[22] Filed: Dec. 2, 1992

[51] Int. Cl.[5] ..... E04B 2/00; E01C 11/02; E01C 11/04

[52] U.S. Cl. ..... 52/367; 52/364; 404/47

[58] Field of Search ..... 52/250, 255, 256, 257, 52/259, 364, 365, 367, 368, 369; 404/43–48, 64, 68–70

[56] References Cited

U.S. PATENT DOCUMENTS

| | | | |
|---|---|---|---|
| 4,423,979 | 1/1984 | Brown | 404/47 X |
| 4,576,510 | 3/1986 | Ljungkvist et al. | 404/47 X |
| 4,727,690 | 3/1988 | Honeyman | 52/364 X |
| 4,804,292 | 2/1989 | DeLuca | 404/47 X |
| 4,841,704 | 6/1989 | Jarrell | 404/48 X |

*Primary Examiner*—Neill R. Wilson
*Attorney, Agent, or Firm*—Allegretti & Witcoff, Ltd.

[57] ABSTRACT

A screed rail assembly for use in the construction of concrete slabs includes an elongated rail having a plurality of locking members that extend outward from the sides of the rail. The locking members provide a positive mechanical connection between the concrete slab and the screed rail, preventing structural damage due to external forces exerted against the slab. An elongated protective strip extends along the top surface of the elongated rail, further protecting the junction between the slab and the rail from damage due to external forces.

2 Claims, 7 Drawing Sheets

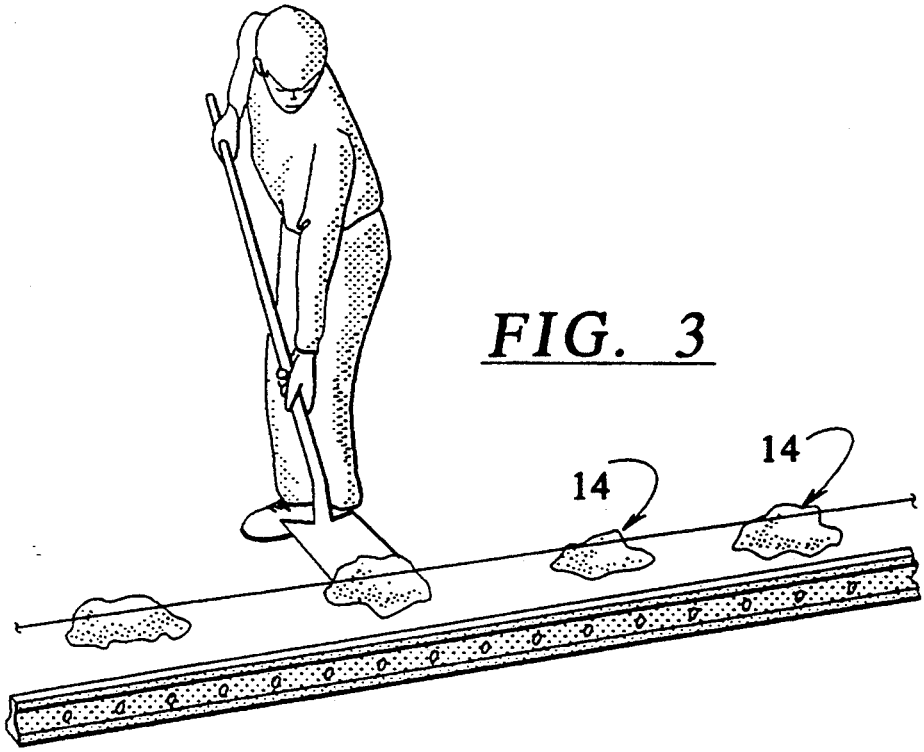
FIG. 3
FIG. 4
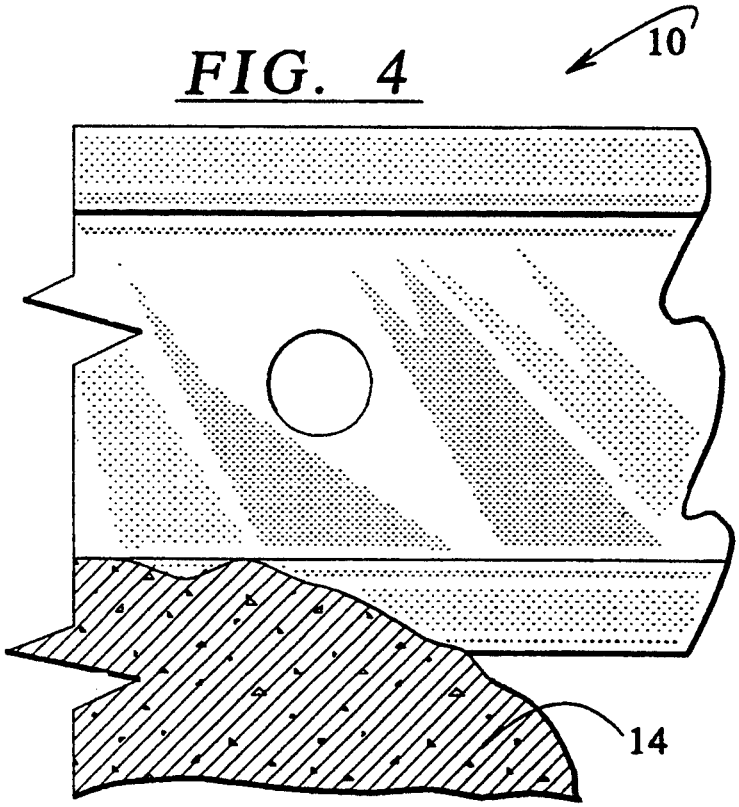

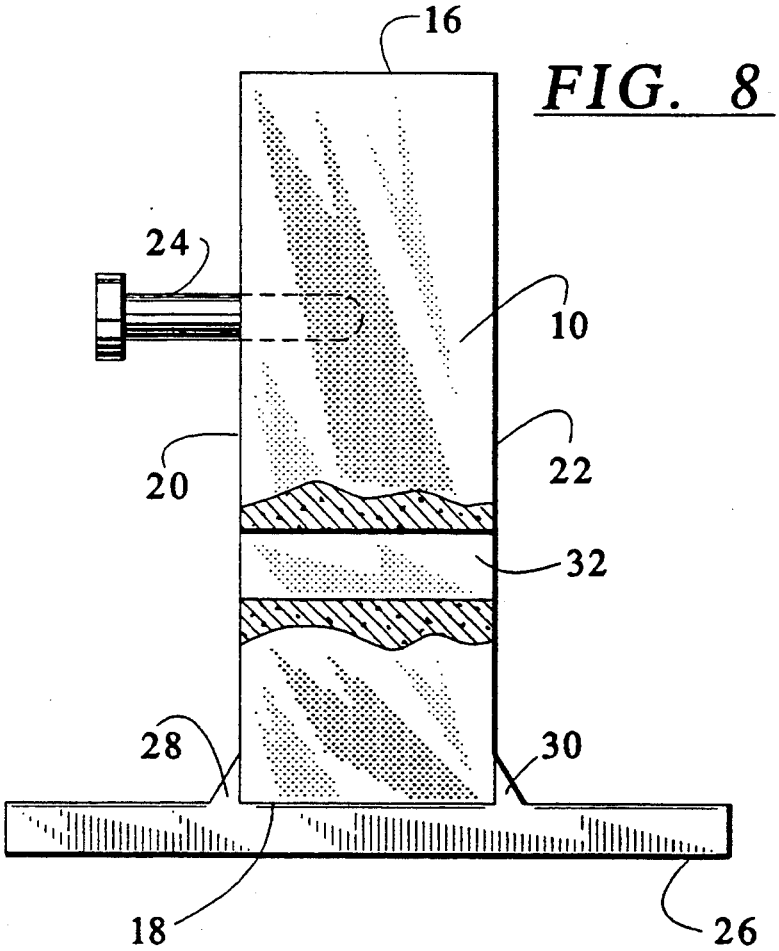
FIG. 8
FIG. 9
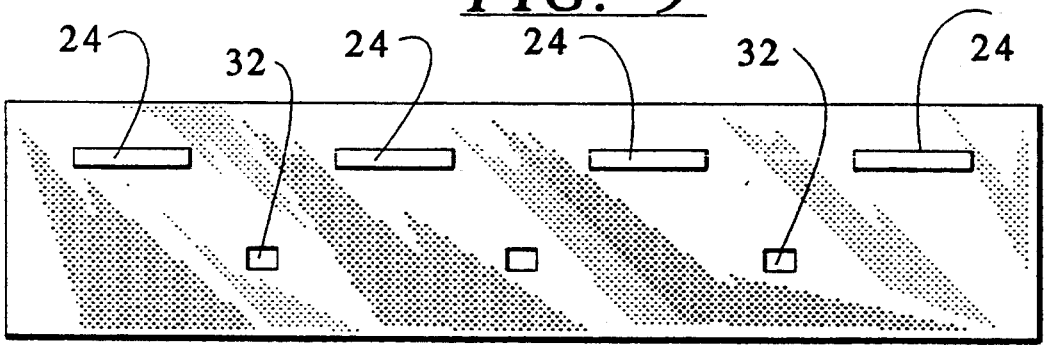

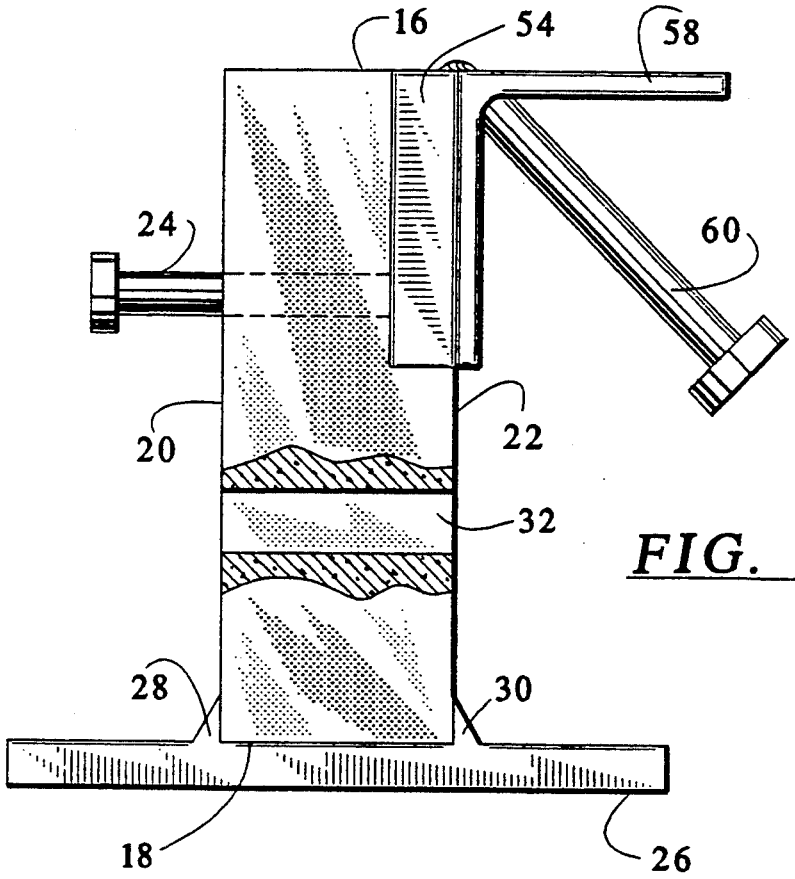
FIG. 10
FIG. 11
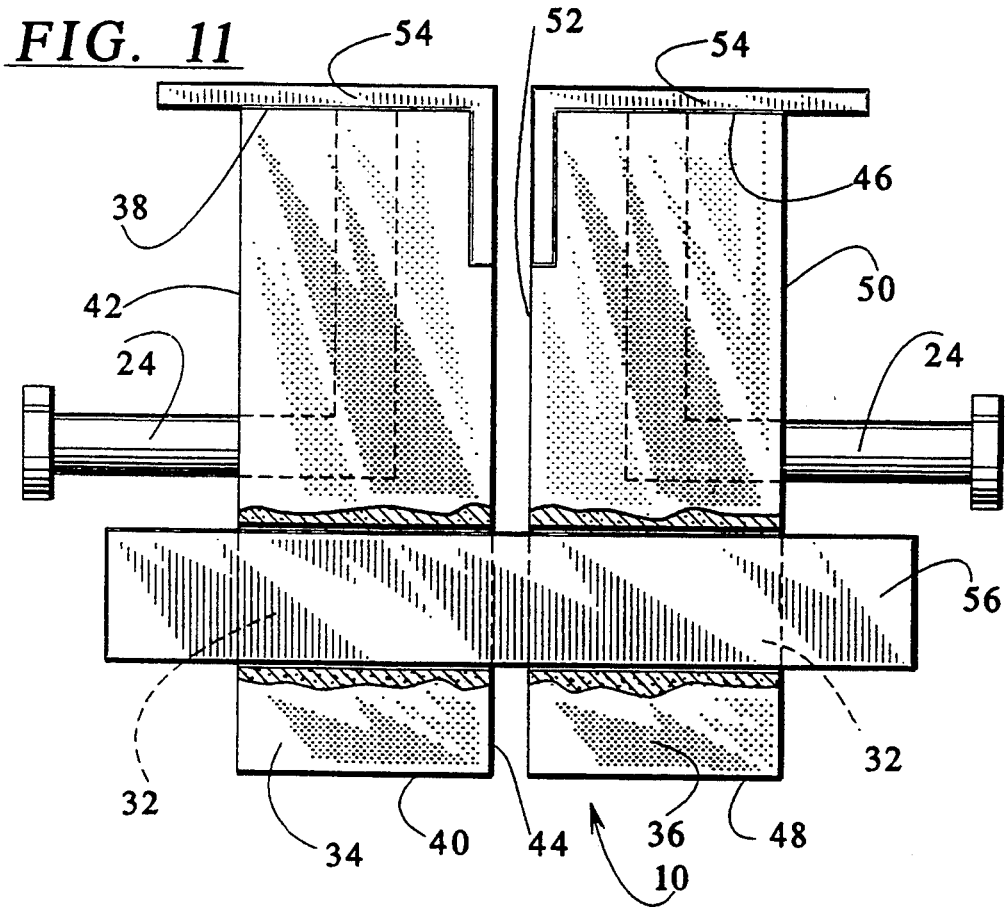

POSITIVE LOCKING CONCRETE SCREED RAIL

BACKGROUND OF THE INVENTION

This invention relates generally to the construction of concrete slabs. More specifically, the invention relates to improved screed rails for use as forms in the construction of concrete slabs.

In the construction of concrete slabs, it has long been the practice to use forms to define the area into which the concrete slab is to be poured. The forms serve to contain the concrete mixture when it is poured and while it hardens. When a large slab is to be poured, forms are commonly used to divide the slab into smaller subsections, each of which is poured separately.

Temporary forms, such as wooden planks, have been used for many years. However, there are a number of disadvantages that are associated with the use of temporary forms. Most notably, if concrete is poured into adjacent subsections at the same time, it is difficult, if not impossible, to remove temporary forms from between the subsections once the concrete has hardened. It is therefore necessary to avoid pouring concrete into adjacent sections at the same time. A further disadvantage of temporary forms is that once the slab is completed, the forms must removed, and then either be transported away from the job site, or otherwise disposed of.

Many of these problems have been remedied through the development of permanent containment forms, or screed rails. These screed rails, which are made primarily of concrete, can be used to define the area into which the concrete slab is to be poured, and to contain the concrete mixture during pouring and hardening operations. Unlike temporal forms, however, they are left in place after the concrete is poured, becoming part of the finished slab. As a result, a slab can be poured more easily, with adjacent subsections being filled with concrete simultaneously. Upon drying, the concrete slab simply adheres to the screed rails, which in essence become part of the slab. U.S. Pat. Nos. 4,884,384, 4,576,510, 4,598,517 and 4,950,434 are incorporated here by reference, to detail, inter alia, the construction and use of such screed rails.

In general it is necessary to provide occasional seams or gaps between the subsections of a concrete slab, in order to allow the slab to contract or expand in response to volume changes or temperature fluctuations. In the absence of such gaps, the slab may crack or buckle as it expands or contracts in response to volume or temperature changes. In situations where permanent screed rails are used, it has previously been known that a debonding agent can be sprayed along one side of a rail to prevent the concrete slab from adhering to that side of the rail. When this is done, a gap is formed between the slab and the screed rail, since the concrete slab typically pulls away from the rail as it dries.

However, one problem that has been found to exist in the construction of concrete slabs in general is that the seams or gaps between sections of a slab are prone to physical damage, referred to as spalling, when the slab is subjected to large downward forces. Such forces may, for instance, be created when a forklift or other such vehicle rolls across the slab. These problems are especially severe in situations involving the use of heavy forklifts having metal wheels with small diameters, since the heavy downward force that is exerted against the slab by the forklift is focused onto a very small area.

It is therefore an object of this invention to provide a permanent screed rail assembly for use in the construction of concrete slabs, wherein the rail assembly will protect against structural damage along the portions of the slab edges that are exposed to these forces, while providing the ability for the slab to expand or contract in response to volume or temperature changes.

SUMMARY OF THE INVENTION

In a basic aspect, the claimed invention comprises an elongated rail having a top surface, a bottom surface, first and second outer surfaces, and one or more locking members projecting outward from at least one of the outer surfaces of the elongated rail. When the slab is poured against the rail, it surrounds the locking members, which become fixed in the slab after it has dried. As a result, a positive mechanical link is formed between the screed rail and the slab. An elongated protective strip extends along the top surface of the elongated rail, further protecting the junction between the slab and the rail from damage due to external forces.

The ability of the slab to contract or expand in response to volume or temperature fluctuations is provided in either of two general ways. First, a single piece rail, such as that described below in the first preferred embodiment, can be used. One side of the rail is provided with locking members, allowing the slab to become firmly fixed to that side of the rail. The other side of the rail is sprayed with a debonding agent, allowing a gap to form between the rail and the slab. Alternatively, a two-piece rail, described below as the second preferred embodiment, can be used. In that situation, both of the outer surfaces of the rail are provided with locking members, allowing the slab to become firmly fixed to both sides of the rail. The two sections of the rail are separated by a gap, and move relative to each other in response to expansion and contraction of the slab.

BRIEF DESCRIPTION OF THE DRAWINGS

FIG. 3 of the drawing depicts the placement of concrete pads for supporting a screed rail in place.

FIG. 4 of the drawing is a side view along the length of a screed rail, showing the rail in position atop a concrete pad.

FIG. 8 of the drawing is a cross-sectional view of the first preferred embodiment.

FIG. 9 of the drawing is a side view along the first outer surface of the first preferred embodiment.

FIG. 10 of the drawing is a cross-sectional view of the first preferred embodiment, showing structural details of the protective strip.

FIG. 11 of the drawing is a cross-sectional view of the second preferred embodiment.

DETAILED DESCRIPTION OF THE PREFERRED EMBODIMENTS

Figure 1:
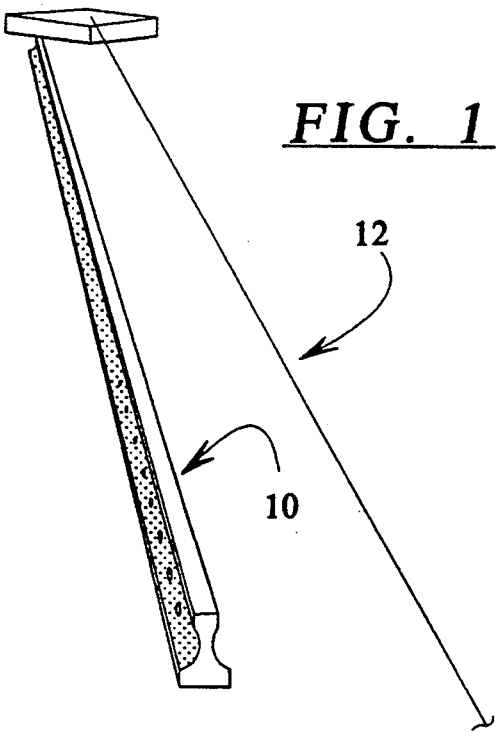
FIG. 1 of the drawing depicts an arrangement for marking the position into which a screed rail is to be placed.
Figure 2:
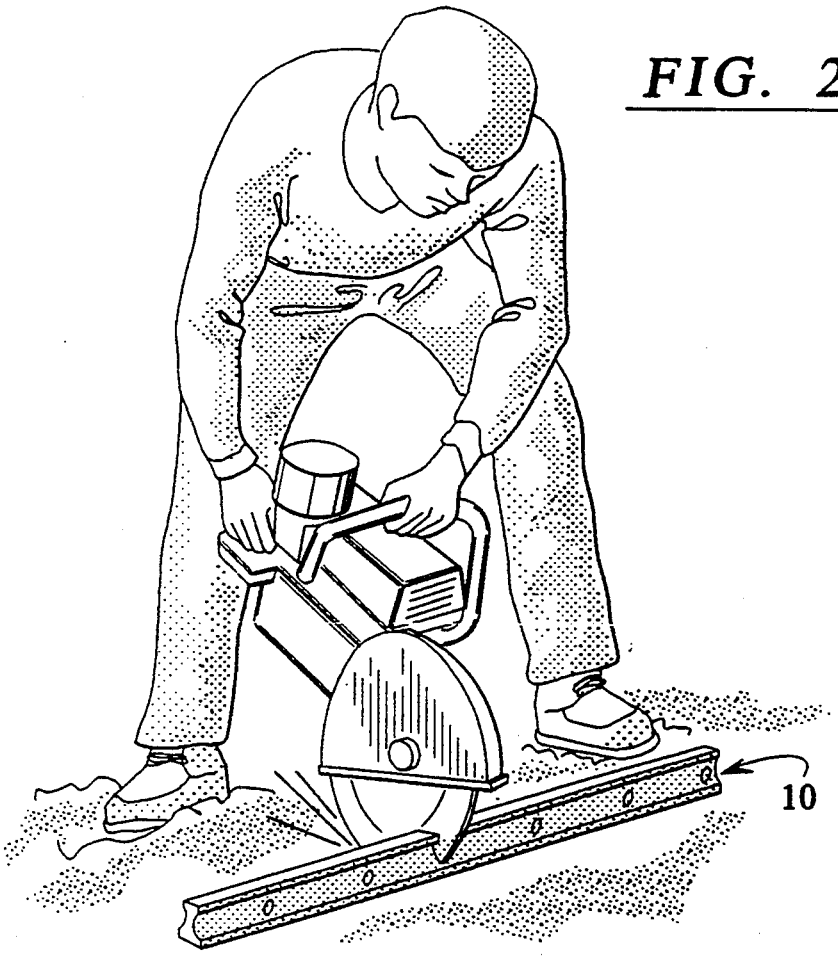
FIG. 2 of the drawing depicts a method for cutting a screed rail to a desired length.
Figure 5:
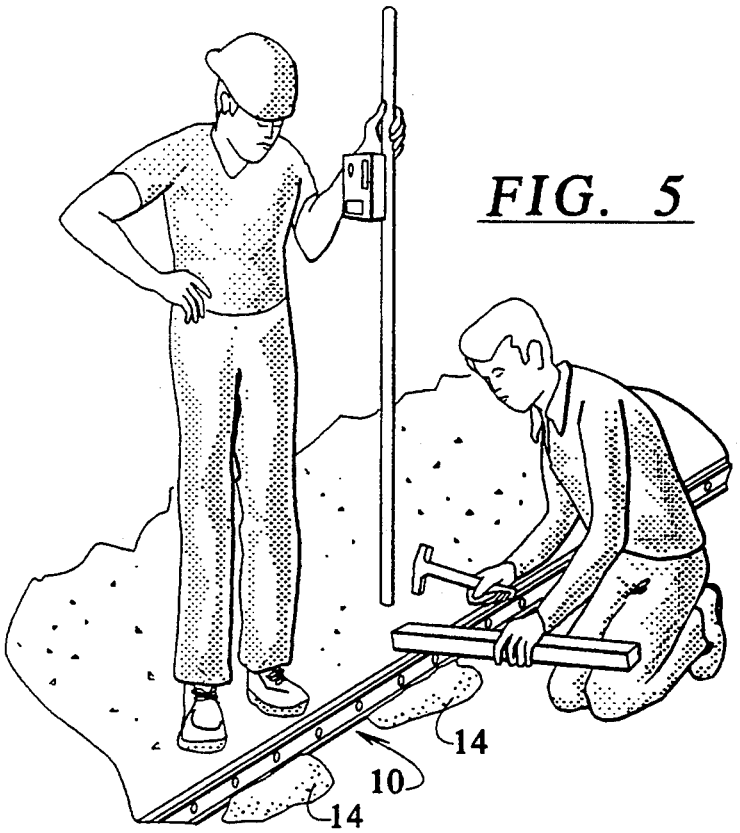
FIG. 5 of the drawing depicts a procedure for leveling a screed rail.
Figure 6:
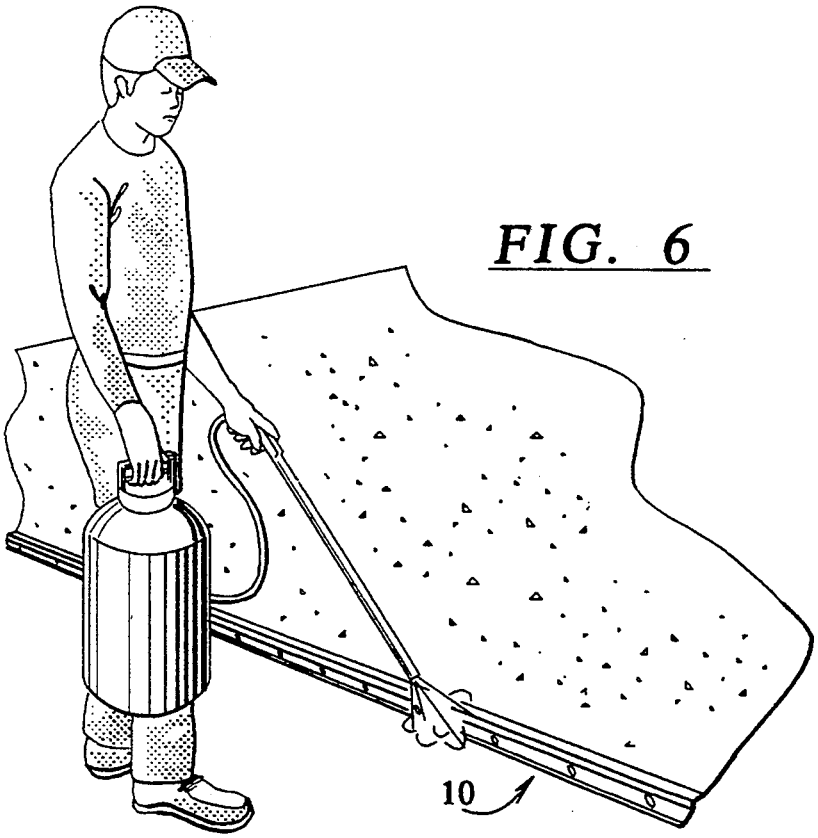
FIG. 6 of the drawing depicts the use of a debonding agent to prevent adherence of the concrete slab to the rail.
Figure 7:
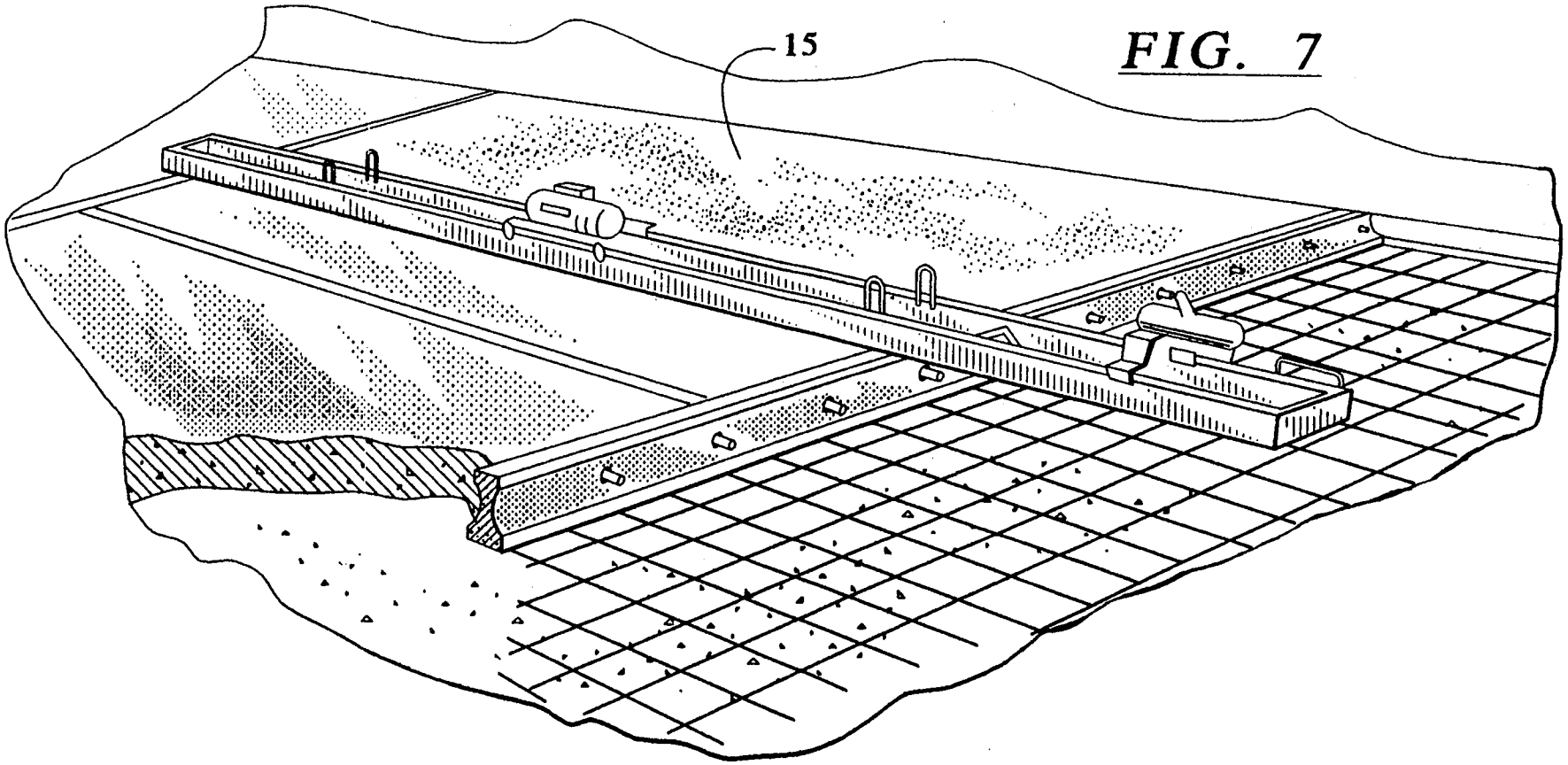
FIG. 7 of the drawing shows an arrangement for leveling the poured slab before the concrete hardens.

In general, permanent screed rails are used in accordance with the following description. First, as shown in FIG. 1, the desired position of each rail 10 is determined, and marked with a straight line or string 12. Referring to FIG. 2, the rail 10 is then cut to the desired length using a masonry saw or the like. Referring to FIG. 3, portions of concrete are set into place, at approximately three foot intervals, to act as pads 14 for the rail. The pads can be contained in wire cages. Turning to FIG. 4, the rail 10 is then set into position on the pads 14 at an appropriate height, taking into account the ultimate thickness of the slab to be poured. After the rail 10 has been set into place, and before the concrete pad 14 has fully hardened, the rail should be leveled using a carpenter's level or laser, and a hammer and block of wood, as shown in FIG. 5. The procedure is repeated for each of the rails that define the slab. In situations where the rail is a single piece rail, such as that described below as the first preferred embodiment, a debonding agent can be sprayed or brushed against the outer surface to the rail 10 before the concrete is poured into the section, as shown in FIG. 6. This will allow a gap to form between the slab and the rail on that side, to compensate for expansions and contractions of the slab. After the rails have been positioned, concrete is poured into place to form the slab 15. Once the concrete slab 15 has been poured, but before it has hardened, the concrete can be leveled by moving a straight edge along opposite rails, as shown in FIG. 7. The straight edge can be equipped with a vibrator.

Turning to FIG. 8, a first preferred embodiment of the claimed screed rail assembly is shown. A rail 10 has a top surface 16, a bottom surface 18, a first outer surface 20, and a second outer surface 22. One or more locking members, 24, project outward from the first outer surface. Locking members can also extend outward from the second outer surface 22 of the rail 10. The rail 10 is positioned on a plate 26, between a set of flanges, 28 and 30 respectively. The plate can be made of metal or other material which will adequately support the rail in position. Alternatively, the plate 26 can be omitted, and the lower portion of the rail 10 can instead be tapered outward so that the rail is wider at its bottom. As shown in FIG. 9, the locking members 24 can be substantially flat, being cut from lengths of steel strip. Alternatively, the locking members can be in the form of studs or pins extending from the rail. A portion of the locking member should be thicker than the remainder of the member, in order to insure that the member will remain firmly embedded in the slab. For instance, where the locking member is in the form of a pin or stud, the end of the member can be shaped similarly to the head of a bolt. Alternatively, the surface of the locking member can be roughened or deformed in order to increase the mechanical connection between the slab and the locking member. Where a plurality of locking members are used, they may be positioned at regular or irregular intervals along the length of the rail 10. A plurality of passages 32, preferably square in cross section, extend horizontally through the rail 10 at regular intervals. As discussed later with respect to the second preferred embodiment, dowels may be passed through these passages in order to provide equal load transfer to the slab on each side of the rail.

If it is desired to have a gap between the slab and the rail, in order to allow expansion and contraction of the slab in response to volume or temperature fluctuations, one of the outer surfaces of the rail can be left free from locking members, and sprayed with a debonding agent.

As shown in FIG. 10, an elongated protective strip 54 can extend along the top or outer surface opposite the locking member 24, and can actually be coextensive with the locking member. This strip provides protection for the corner of the rail. A steel angle, 58, is tack welded onto the protective strip 54, to extend outward over the slab once the slab is poured in place against the outer surface of the rail. A locking member 60 can extend downward from the angle to fix provide a positive mechanical connection between the slab and the steel angle 58.

Turning to FIG. 11, a second preferred embodiment is shown. In this embodiment, the rail 10 comprises a first half-rail 34 and a second half-rail 36. The first half-rail 34 has a top surface 38, a bottom surface 40, an outer surface 42, and an inner surface 44. Similarly, the second half rail 36 has a top surface 46, a bottom surface 48, an outer surface 50, and an inner surface 52. The lower portion of the outer surface of each half rail can be tapered outward, so that the rail is wider at the bottom than at the top.

In order to form the elongated rail 10, the first and second half-rails are positioned with their inner surfaces adjacent to one another. The outer surfaces of the half-rails make up the outer surfaces of the rail 10. Locking members 24, preferably in the form of pins or studs, are embedded in each half rail and project outward from the outer surface of the half-rail.

Figure 12:
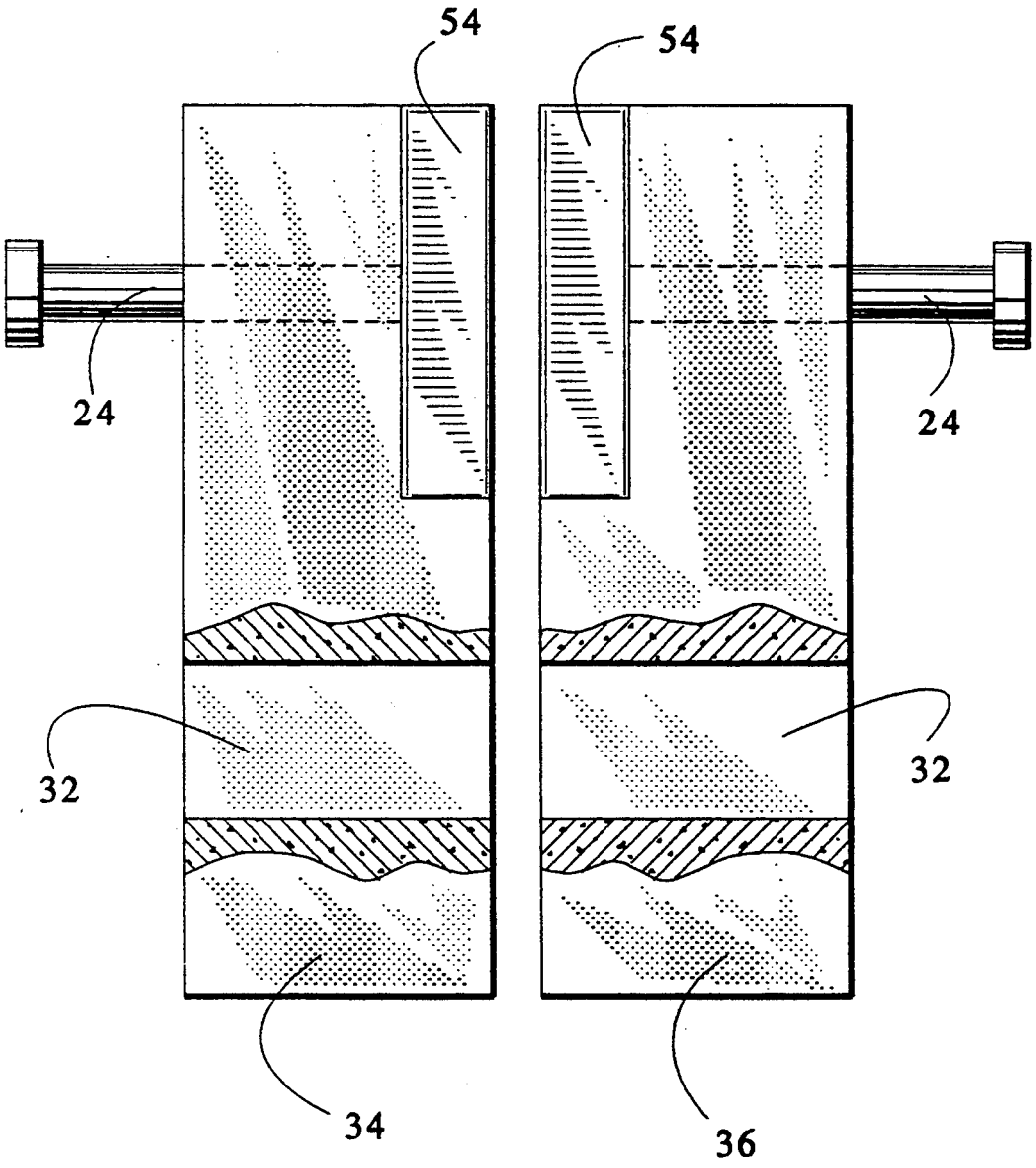
FIG. 12 of the drawing is a cross-sectional view of the second preferred embodiment, showing an alternate relationship between the half-rails and the elongated protective strips.

The opposite end of the locking pin 24 is fixed to an elongated protective strip 54, which extends along the respective half-rail. The protective strip is generally made of metal, but can be made of any durable material, such as a modified polymer concrete or a modified epoxy. The protective strip 54 protects the corner that is formed by the top and inner surfaces of the half-rail from damage due to downward forces against the slab. The protective strip can be positioned in a number of different ways relative to the rail. For instance, as shown in FIG. 11, the protective strip can have a right angle cross section, and can be positioned against both the inner and top surfaces of the associated half-rail, projecting horizontally outward past the outer surface of the half rail. Alternatively, the protective strip can be have a flat cross section, and be positioned against the inner surface of the associated half-rail, flush with the top surface of the rail, as shown in FIG. 12.

Returning to FIG. 11, a plurality of passages 32 pass through each half rail. These passages are preferably square in cross section. Steel dowels 56, the outer surface of which conform closely to the inner surface of the passages 32, are passed through the corresponding passages 32 of each half-rail. The dowels serve to maintain the alignment of the half-rails during manufacturing and shipment. More importantly, they equalize the load transfer between the two half-rails and the associated portions of the slab.

While in the foregoing there have been described preferred embodiments of the invention, it should be understood to those skilled in the art that various modifications and changes can be made without departing from the true spirit and scope of the invention as recited in the claims.

What is claimed is:

1. A screed rail assembly for use in the construction of a concrete slab, comprising a) an elongated rail comprising separate first and second half rails, each half rail having a top surface, a bottom surface, an outer surface, and an inner surface, with the inner surfaces of each half rail being positioned adjacent to one another, and b) one or more locking members projecting from at least one of the outer surfaces of one of the half rails, and c) an elongated protective strip that extends along the upper surface of at least one of the half rails, and also extends along the inner surface of said one of the half rails.

2. A screed rail assembly for use in the construction of a concrete slab, comprising:

a) an elongated rail having a top surface, a bottom surface, and first and second outer surfaces, and b) an elongated protective strip that extends along the top surface of the elongated rail, characterized in that the elongated rail comprises separate first and second half rails, each having a top surface, a bottom surface, an outer surface, and an inner surface, with the inner surfaces of each half rail being positioned adjacent to one another, wherein the elongated protective strip also extends along the inner surface of at least one of the half rails.

* * * * *